US008689841B2

(12) United States Patent
Bortz

(10) Patent No.: US 8,689,841 B2
(45) Date of Patent: Apr. 8, 2014

(54) COMPARTMENTED STRAP-COILED BAGS

(75) Inventor: Dave Bortz, Tel Aviv (IL)

(73) Assignee: Zipit Ltd., Ramat Gan (IL)

( * ) Notice: Subject to any disclaimer, the term of this patent is extended or adjusted under 35 U.S.C. 154(b) by 514 days.

(21) Appl. No.: 12/862,788

(22) Filed: Aug. 25, 2010

(65) Prior Publication Data

US 2012/0048433 A1 Mar. 1, 2012

(51) Int. Cl.
*A45C 3/06* (2006.01)
*A45C 13/10* (2006.01)

(52) U.S. Cl.
USPC ..... 150/127; 150/112; 190/1; 190/109; 190/903; 383/97

(58) Field of Classification Search
USPC ..... 190/1, 17, 109, 900, 903; 383/4, 97; 2/301.312; 150/112, 127, 128
See application file for complete search history.

(56) References Cited

U.S. PATENT DOCUMENTS

| | | | | | |
|---|---|---|---|---|---|
| 2,321,808 | A * | 6/1943 | Govan | 2/300 |
| 3,117,607 | A | 1/1964 | Siegel | |
| 4,176,772 | A * | 12/1979 | Danon | 224/148.5 |
| 4,710,983 | A * | 12/1987 | Markoff | 2/301 |
| 4,988,097 | A * | 1/1991 | Smith et al. | 482/105 |
| 5,025,819 | A * | 6/1991 | Taylor | 135/16 |
| D326,560 | S * | 6/1992 | Schanzer | D3/301 |
| 5,683,022 | A * | 11/1997 | Evans | 224/583 |
| 6,647,555 | B2 * | 11/2003 | Yamaguchi et al. | 2/338 |
| 6,913,176 | B1 * | 7/2005 | Buscemi | 224/665 |
| 7,509,985 | B2 | 3/2009 | Metsch | |
| 2003/0178459 | A1 * | 9/2003 | Aniwanou | 224/587 |
| 2003/0189076 | A1 * | 10/2003 | Shapess | 224/587 |
| 2007/0044878 | A1 | 3/2007 | Metsch | |
| 2007/0099774 | A1 * | 5/2007 | Bruback | 482/105 |
| 2007/0270731 | A1 | 11/2007 | Sloot | |
| 2008/0185412 | A1 | 8/2008 | Hollins | |
| 2008/0203123 | A1 * | 8/2008 | de Leon | 224/217 |

* cited by examiner

*Primary Examiner* — Sue A Weaver
(74) *Attorney, Agent, or Firm* — Sorokes Agmon

(57) ABSTRACT

A compartmented bag having a cavity, comprising a coiled strap having at least one compartment thereon, and a fastener about a circumference of the strap linking adjoining coiled edges of the strap.

6 Claims, 6 Drawing Sheets

Prior Art

COMPARTMENTED STRAP-COILED BAGS

FIELD OF THE INVENTION

The present disclosure generally relates to a bag formed by turning a strap around, and more specifically to a bag formed by turning a strap having a compartment.

BACKGROUND OF THE INVENTION

Bags comprising an elongated strap or band having a zipper member about longitudinal edges thereof by turning the strap or band around and joining the zipper members are known. Such articles are formed by attaching sections of the strap or band, such as by a zipper about the elongated edges thereof. Representative articles are provided, for example, as ZipIt® zipper bags (© zipit ltd., http://www.just-zipit.com).

SUMMARY OF THE INVENTION

An aspect of the some embodiments of the invention relates to coiled bags with compartments and methods for forming such bags.

In some embodiments a bag having at least one compartment is formed by spirally curling or coiling a strap having at least one compartment and connecting or linking or attaching adjoining edges of the strap as the strap is curled or coiled around.

In some embodiments of the invention, the strap comprises or formed with or coupled with a fastener or fasteners at or about the longitudinal edges or circumference thereof, where a fastener matches or links with or attaches to the fastener at adjacent edges of the strap as the strap is coiled.

In some embodiments, the strap is spirally curled or coiled around and the walls are successively formed as the strap is progressively coiled and the fasteners adhere at adjoining edges of the strap.

In some embodiments, the fastener is a one sided zipper member that meshes with an adjacent zipper member as the strap is curled around.

In some embodiments, the fastener is formed as hoops-and-loops, optionally formed as partly hoops and partly loops so that adjacent edges can link together.

In some embodiments, the fastener comprises or made of a peelable adhesive. In some embodiments the fastener comprises or made of magnetic bars. Optionally or alternatively, the fastener is or made of other fastening elements of the art, such as snap seal or as ball-and-socket or hook-and-eye.

In some embodiments, the strap is formed with a plurality of compartments. In some embodiments, a compartment is formed as an elongated structure extending about some length or major part of the length of the strap or about of the length of the strap. In some embodiments, a compartment is closable and/or openable and/or removable, for example, as an additional strip or strips connected or connectable to the strap that can be closed to form a space therebetween. Te additional strip or strips can be connected and openably closed therebetween or to the strap with an openable fastener such as a zipper or hooks-and-loops or peelable adhesive or snap seal. In some embodiments, the additional strip and the strap share the same zipper so the compartment is formed concurrently as the strap is coiled to form the bag, and reversely, the compartment is opened as the bag is un-coiled.

In some embodiments, a compartment is formed as a pocket or series of pockets where, optionally, a pocket extent is considerably small than the length of the strap.

In some embodiments, a plurality of compartments is formed as loops or open-ended closures, spaced over an extent of the strap's length, akin to belt loops. The loops can be used to provide holding structures for elongated article or articles such as power or data cords.

In some embodiments, the compartment or part thereof formed on the strap provide space for storage and/or organizing articles. In some embodiments the compartment is stretchable or elastic for saving space when not used, yet providing larger storage size when needed.

In some embodiments, the space of the compartment is suitable for storing an article such as a power supply or a folded cord or MP3/MP4 player. Optionally, the space of the compartment is suitable for storing a plurality of articles that are arranged or can be arranged in or along the compartment or part thereof. For example, rubber gums, candies, pills or stationery or other articles such as coins or batteries or electronic components such as microchips.

In some embodiments, the compartments are structured to enable storing articles before or during the curling and forming the bag or walls thereof. Optionally or alternatively, the compartments are structured to enable storing articles after the bag is formed.

In some embodiments, the strap at an end part thereof is folded or curved, e.g. like a U-shape, forming a basis for the bag and/or directing the shape thereof. In some embodiments, the folded or curved part comprises or formed with a fastener or fasteners at or about the edges thereof facing each other, optionally providing a starting location for curling and fastening. Optionally or alternatively, the strap comprises at an end thereof a flap or other form providing a base for the bag and/or a starting location for coiling and fastening.

In some embodiments, the strap is formed such that the bag is closed after connecting or linking adjacent edges of the strap as the strap have been turned around. Optionally, the strap is formed with or comprises or provides for members such as handles or flaps for opening or closing the formed bag or buckles.

In some embodiments the strap comprises or is made of a fabric. In some embodiments the strap comprises or is made of plastic. Optionally, the strap comprises or is made of a combination of materials.

In some embodiments, the compartment is bendable and/or flexible for coiling with the strap. In some embodiments the compartment comprises or is made of a fabric. In some embodiments the compartment comprises or is made of plastic. Optionally the compartment comprises or is made of a combination of materials.

In some embodiments, the compartment is made or formed by a separate strip attached to the strap, such as by sewing. Optionally or alternatively, the compartment is made or formed by folding the strap.

In some embodiments, the compartment and/or strap comprises embedded or impregnated material for imparting electrical or heat properties. In some embodiments, the strap provides a wall for a compartment. Optionally or alternatively, the compartment has separate walls.

In some embodiments, such as when not in use, the strap having the compartment or compartments may be folded or rolled into a small package relative to the spread strap or the bag formed therefrom.

For brevity and conciseness, reference to a compartment herein implies the envelope or walls (material) or the hollow inside thereof as evident by the context.

According to an aspect of some embodiments of the present invention there is provided a compartmented bag having a cavity, comprising:

(a) a coiled strap having at least one compartment thereon; and (b) a fastener about a circumference of the strap linking adjoining coiled edges of the strap.

In some embodiments, the fastener is a zipper member. In some embodiments, the fastener is a zipper member disposed around the circumference of the strap.

In some embodiments, the compartment is at least openably closed.

In some embodiments, the compartment is at least closeable opened.

In some embodiments, the strap having at least one compartment comprises at least one strip attached to the strap.

In some embodiments, the strap having at least one compartment comprises two strips attached to the strap, wherein in some embodiments, the two strips are openly closeable with a fastener, and wherein in some embodiments, the fastener is a zipper.

In some embodiments, the strap having at least one compartment comprises a folded strap.

In some embodiments, the compartment is removable from the strap.

In some embodiments, he at least one compartment comprises a plurality of compartments.

In some embodiments, the compartment is located inside the cavity.

In some embodiments, the compartment is located outside the cavity.

In some embodiments, the compartment is at least one of waterproof, thermal isolating, antistatic, electrically isolating, electric fields isolating, or a combination thereof.

In some embodiments, the coiled strap is formed by stitching a plurality of strips.

According to an aspect of some embodiments of the present invention there is provided a method for forming a compartmented bag, comprising:

(a) providing a strap having at least one compartment thereon and a fastener about a circumference of the strap; and (b) coiling the strap and connecting by the fastener adjoining edges of the strap as the strap is coiled.

In some embodiments, the fastener is a zipper member.

In some embodiments, the fastener is a zipper member disposed around the circumference of the strap.

In some embodiments, the at least one compartment comprises a plurality of compartments.

In some embodiments, providing the strap having a fastener about a circumference thereof comprises:

(a) providing a strap;

(b) providing a fastener; and (c) attaching the fastener about the circumference of the strap.

In the specification and claims the following terms imply the respective non-limiting characterizations below.

Bag—a bag, or a pouch, or a purse or any receptacle having a cavity.

Strap—a bendable or flexible strap or band or strip having a length and lengthwise (longitudinal) circumferential edges (and having a width generally perpendicular to the length).

Compartment—enclosed space having a wall and at least one opening.

Coiled—winded into spirals in a series of loops, akin to coiling a rope.

BRIEF DESCRIPTION OF THE DRAWINGS

Some non-limiting exemplary embodiments of the invention are illustrated in the following drawings.

Identical or duplicate or equivalent or similar structures, elements, or parts that appear in one or more drawings are generally labeled with the same reference numeral, optionally with an additional letter or letters to distinguish between similar objects or variants of objects, and may not be repeatedly labeled and/or described.

Dimensions of components and features shown in the figures are chosen for convenience or clarity of presentation and are not necessarily shown to scale or true perspective. For convenience or clarity, some elements or structures are not shown or shown only partially and/or with different perspective or from different point of views.

Figure 1:
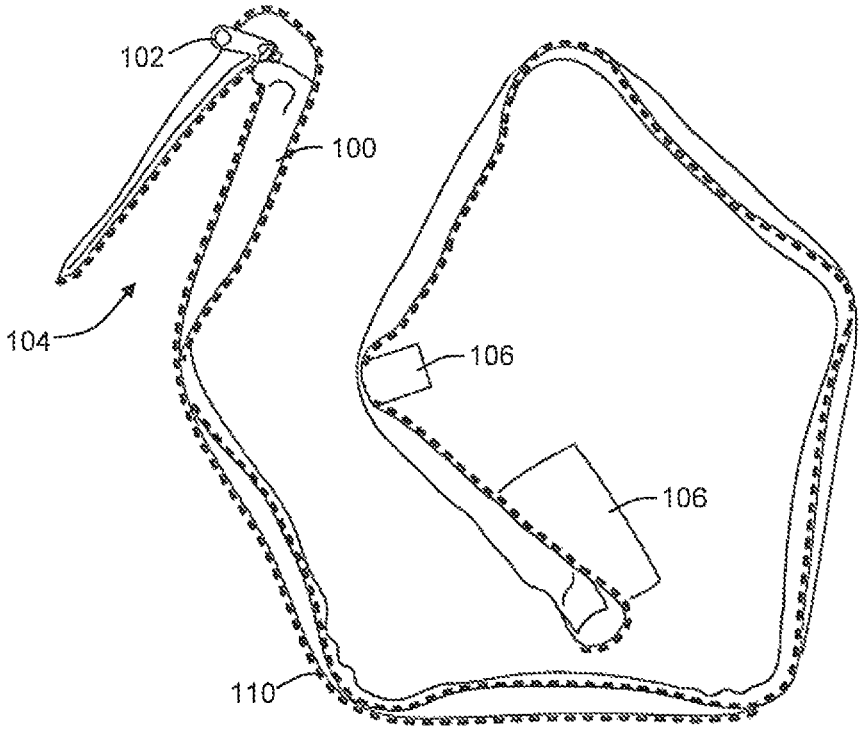
Figure 2A:
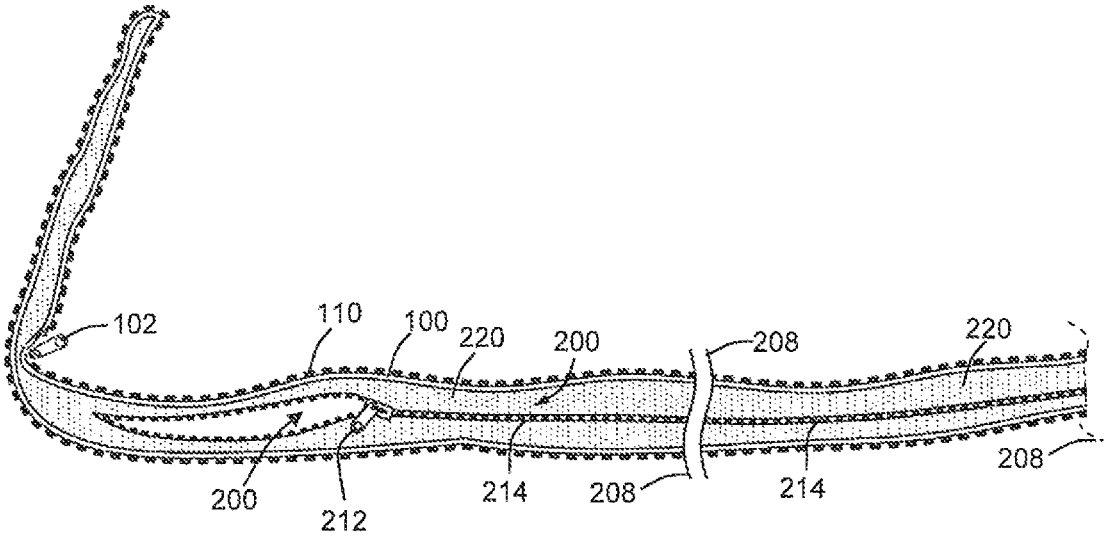
Figure 2B:
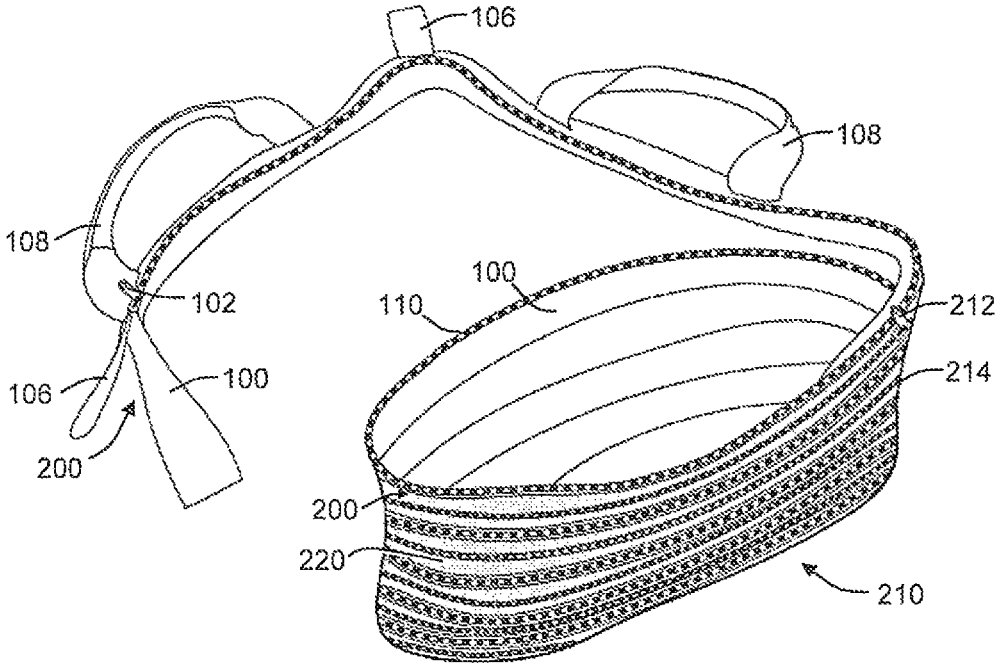
Figure 2C:
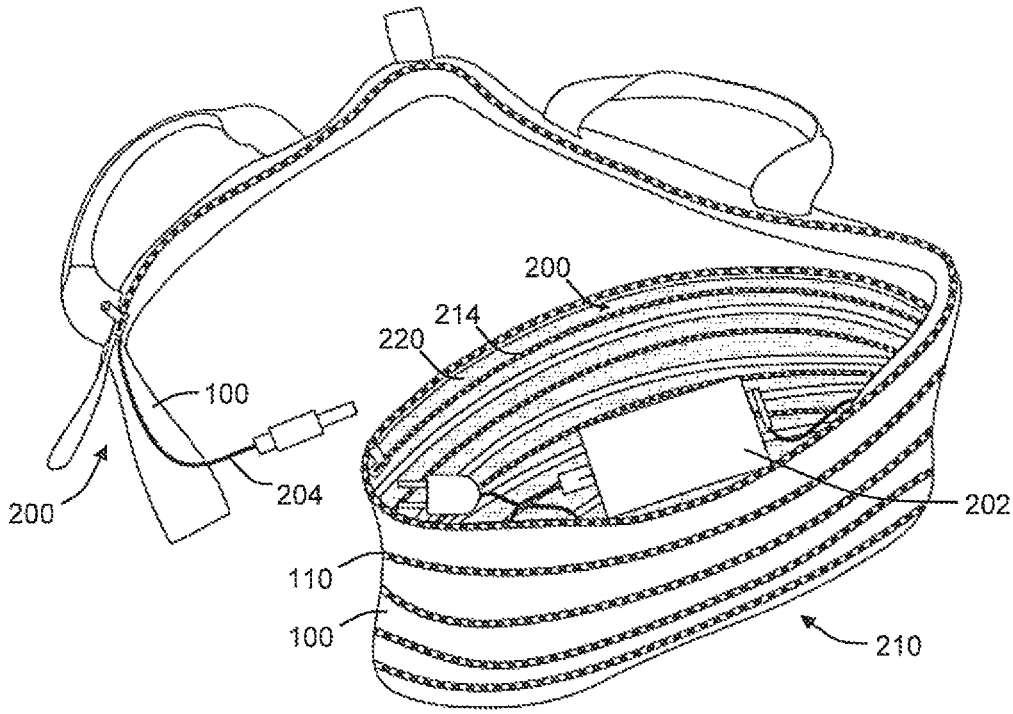
Figure 3:
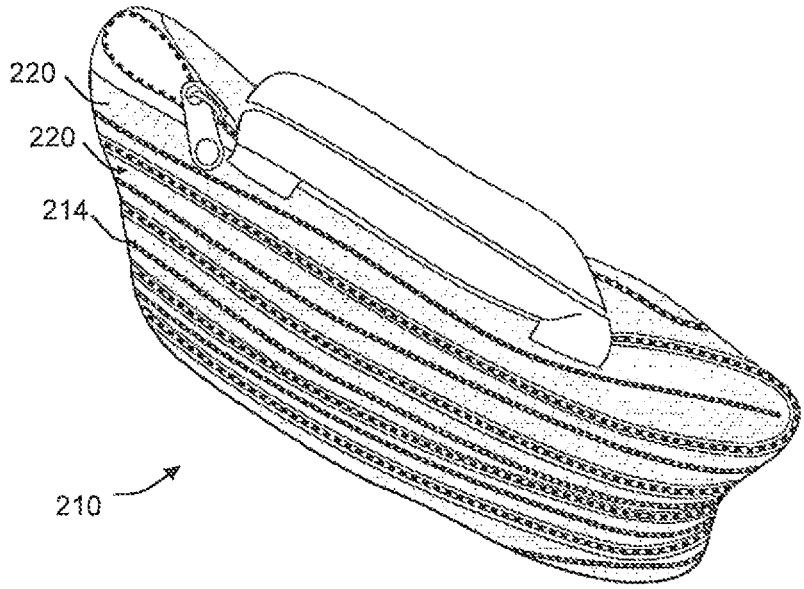
Figure 4:
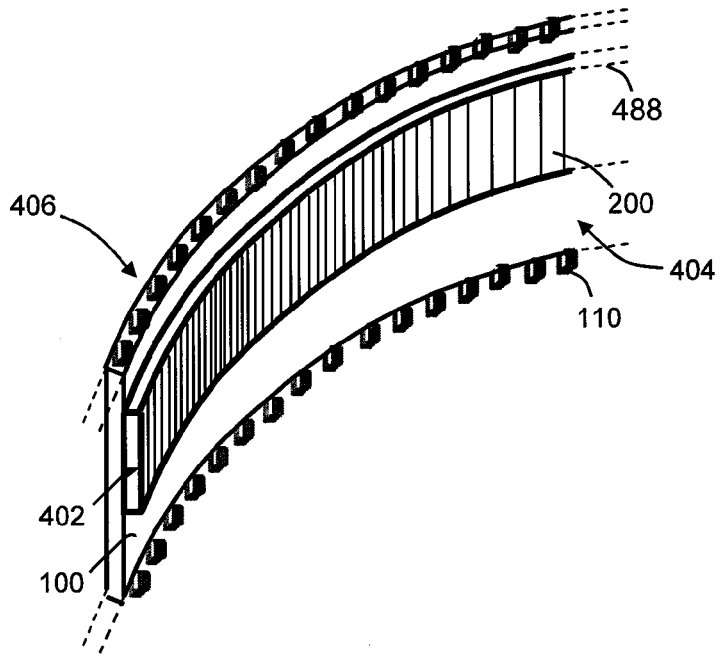
Figure 5:
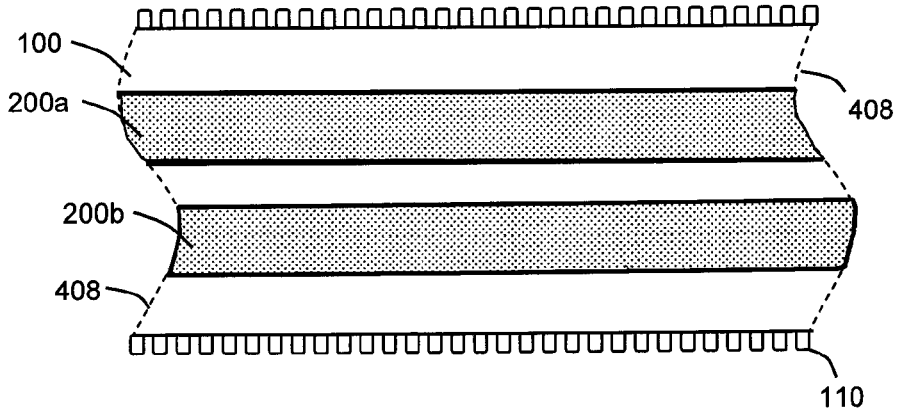
Figure 6A:
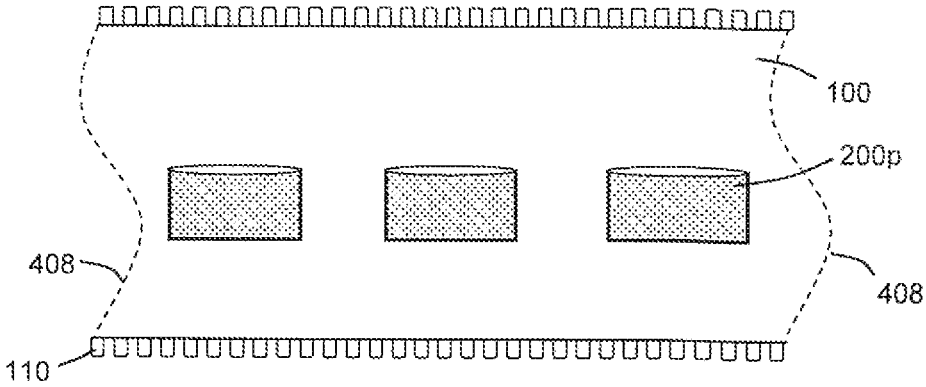
Figure 6B:
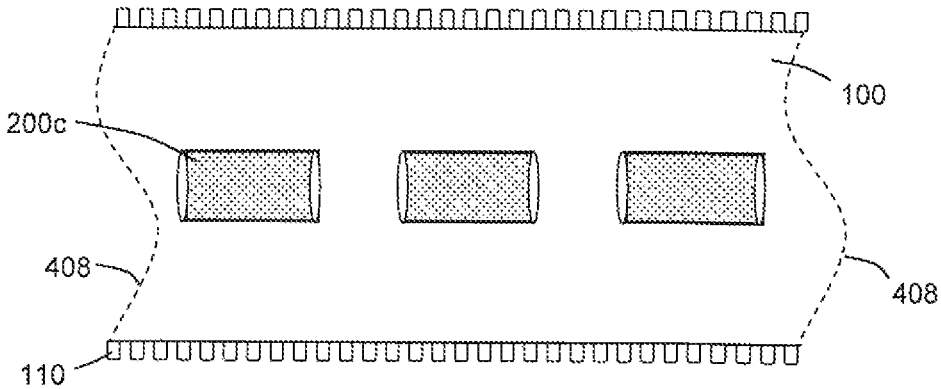
Figure 6C:
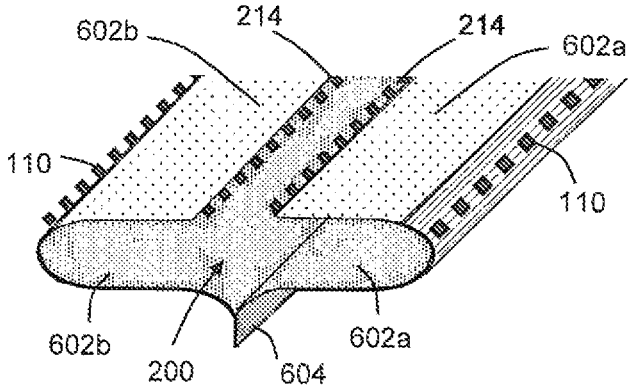
Figure 7:
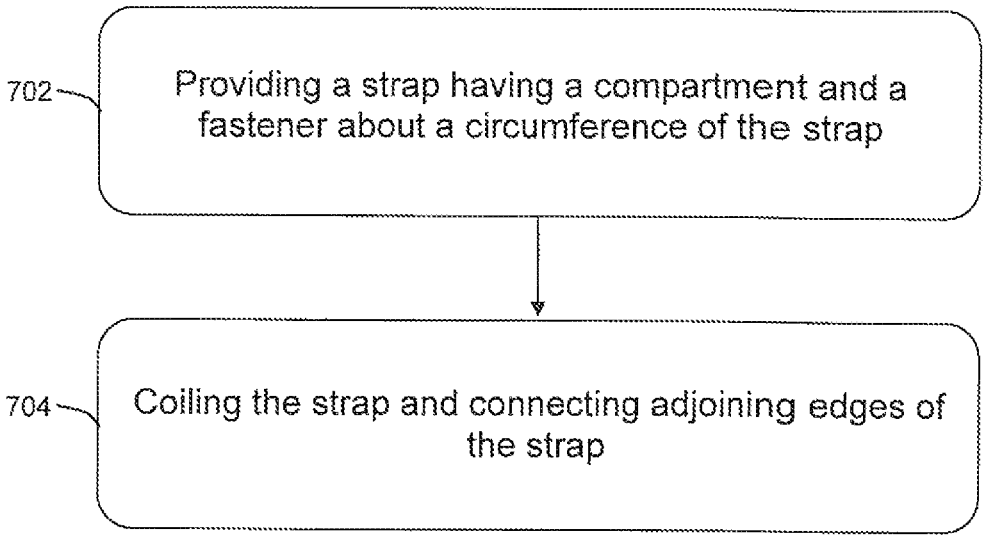

FIG. 1 schematically illustrates a strap for coiling into a bag as know in the art;

FIG. 2A schematically illustrates a strap comprising a compartment for coiling into a bag with a compartment, according to exemplary embodiments of the invention;

FIG. 2B schematically illustrates a strap partly coiled into a partly formed bag with a compartment, according to exemplary embodiments of the invention;

FIG. 2C schematically illustrates a strap comprising a compartment for coiling into a bag storing a power supply and cord, with a compartment, according to exemplary embodiments of the invention;

FIG. 3 schematically illustrates a coiled bag having an internal.compartment, according to exemplary embodiments of the invention;

FIG. 4 schematically illustrates a perspective view of a section of a strap having a compartment, according to exemplary embodiments of the invention;

FIG. 5 schematically illustrates a side view of a section of a strap having two compartments along a side thereof, according to exemplary embodiments of the invention;

FIG. 6A schematically illustrates a side view of a section of a strap having a plurality of pocket compartments, according to exemplary embodiments of the invention;

FIG. 6B schematically illustrates a side view of a section of a strap having a plurality of loop compartments, according to exemplary embodiments of the invention;

FIG. 6C schematically illustrates a perspective view of a section of two strips stitched together forming a strap having a compartment, according to exemplary embodiments of the invention; and FIG. 7 is a flowchart outlining operation for forming a coiled bag with a compartment, according to exemplary embodiments of the invention.

DETAILED DESCRIPTION

The following description relates to one or more non-limiting examples of embodiments of the invention. The invention is not limited by the described embodiments or drawings, and may be practiced in various manners or configurations or variations. The terminology used herein should not be understood as limiting unless otherwise specified.

A general non-limiting overview of practicing the invention is presented below. The overview outlines exemplary practice of embodiments of the invention, to providing a constructive basis for variant and/or alternative and/or divergent embodiments, some of which are subsequently described.

FIG. 1 schematically illustrates a strap for coiling into a bag as know in the art.

A strap 100 is a flexible band or strip surrounded on the periphery thereof by a zipper 110 with a handle 102 for closing of strap 100 into a bag or splitting back the bag into strap 100 or part thereof.

Strap 100 at an end part thereof is folded like a U-shape fold, shown as 104, with zipper 110 at the edges facing each other. U-shape fold 104 provides a starting location for curling strap 100 and fastening the curls with zipper 110, forming a basis for the bag and directing the shape thereof.

Flaps 106 are auxiliary and optional structures for assisting in curling and zipping strap 100 into a bag or in separating the bag into strap 100 or part thereof, for example, to reduce friction between adjoining zipper sections. In some embodiments, strap 100 comprises or attached with other structures such as carrying handles.

FIG. 2A schematically illustrates strap 100, such as of FIG. 1, additionally comprising a compartment 200, according to exemplary embodiments of the invention. For clarity, only a section of strap 100 and compartment 200 are illustrated, where curves 208 indicated an extension of strap 100 with compartment 200.

In the example of FIG. 2A, compartment 200 is formed by a strip 220 attached onto strap 100, where strip 220 is disposed near the width-wise edges of strap 100 and runs along a length of strap 100.

Strip 220 is openable and closeable by a zipper 214, optionally assisted by a handle 212. The compartment disclosed in FIG. 2A may be internal or external to the bag.

FIG. 2B schematically illustrates strap 100 partly coiled into a bag 210 with compartment 200, according to exemplary embodiments of the invention, where bag 210 is illustrated as a partly formed bag. Compartment 200 if formed outside of bag 210 with strip 220 formed or attached on strap 100, where strip 220 is openable by zipper 214. By opening strip 220, such as by handle 212, an article such as an electrical cord may be inserted into compartment 200.

FIG. 2C schematically illustrates strap 100 partly coiled into bag 210 with compartment 200, according to exemplary embodiments of the invention, where bag 210 is illustrated as a partly formed bag. Compartment 200 if formed inside of bag 210 with strip 220 formed or attached on strap 100, where a power supply 202 with a cord 204 inserted into compartment 200.

In some embodiments, an article or articles, such as power supply 202 and cord 204 are placed by sliding the article into compartment 200 when strap 100 is open, i.e., when strap 100 is spread (un-coiled) such as illustrated, for example, in FIG. 1 or FIG. 2A.

FIG. 3 schematically illustrates bag 210 having on the external surface thereof compartment 200 formed with strip 220, according to exemplary embodiments of the invention.

FIG. 4 schematically illustrates a perspective view of a section of a strap 100 having a compartment 200 along a length of strap 100 at a side 404 thereof and zipper 110 at the peripheral longitudinal edges thereof, according to exemplary embodiments of the invention. Dashed lines such as 488 indicate a continuation of the section.

In some embodiments, compartment 200 is hollow therethrough, as indicated by arrow 402, allowing insertion of articles such as a cord or other articles such as coins or pills.

In some embodiments, compartment 200 is formed on a side 404 so that after coiling of strap 100, compartment 200 is disposed inside the coiled bag. In some embodiments, compartment 200 is formed on an opposite side 406 so that after coiling of strap 100 compartment 200 is disposed outside the coiled bag. Optionally, a compartment such as compartment 200 is formed on both sides 404 and 406, so that the coiled bag has both internal and external compartments.

In some embodiments, a strap comprises or formed with a plurality of compartments.

FIG. 5 schematically illustrates a side view of a section of strap 100 having two compartments 200*a* and 200*b* along a side thereof, according to exemplary embodiments of the invention. Curves 408 indicate a continuation of strap 100 and compartments 200*a* and 200*b*. Two compartments 200*a* and 200*b* represent any number of compartments such as three or four compartments.

In some embodiments, the compartments have various sized and/or shapes and separation therebetween.

FIG. 6A schematically illustrates a side view of a section of strap 100 having a plurality of compartments 200*p* shaped as pockets, according to exemplary embodiments of the invention.

FIG. 6B schematically illustrates a side view of a section of strap 100 having a plurality of compartments 200*c* shaped as loops or open-ended cylinders with openings generally parallel to zipper 110, according to exemplary embodiments of the invention.

In some embodiments, a compartment is made or formed by a strip attached to the strap, such as by sewing. Optionally or alternatively, the compartment is made or formed by folding the strap and attaching one fastener about longitudinal edge or edges of the folded strap for closing and opening the compartment and another fastener or fastener members along the surface of the strap for coiling the strap.

In some embodiments, two or more strips are stitched together to form a strap.

FIG. 6C schematically illustrates a perspective view of a section of two strips 602*a* and 602*b* stitched together and folded forming a strap having compartment 200 (shown as an open compartment), according to exemplary embodiments of the invention.

Strips 602*a* and 602*b* are joined together about longitudinal edges thereof with a stitch 604, practically forming a strap similar to strap 100 of FIG. 2A. The formed strap is folded by turning each of strips 602*a* and 602*b* over about a half thereof, forming compartment 200. Akin to strap 100 of FIG. 2A, zipper 110 is attached at the longitudinal folded edges or creases of strips 602*a* and 602*b* for coiling the formed strap, and zipper 214 is attached at the longitudinal free edges (opposite to the stitched edges) of strips 602*a* and 602*b* for closing and opening of compartment 200.

In some embodiments, the space or hollow formed by a compartment is suitable or adapted for storing a fluid such as water, fluid, liquid such as soft drink. For example by forming or lining the compartment with waterproof material. Optionally the compartment has an inlet for providing the fluid and/or an outlet for pouring or drinking.

In some embodiments, a compartment comprises an at least partially thermal isolating material so that the compartment is suitable for maintaining the temperature of stored articles, such as warm or cold drink or ice cubes, at least for some time and/or to some extent. Optionally, the thermal isolating material is formed as a liner inside and/or outside the compartment and optionally comprises foam or other isolating material. Optionally the compartment or the strap or part thereof is structured with air pockets or pockets with isolation material.

In some embodiments, a compartment comprises electrically conductive material (e.g. as a copper mesh embedded in a fabric) so that the compartment is isolated for electric fields.

In some embodiments, a compartment is electrostatically isolated such as by employing antistatic agents (e.g. impregnated in a fabric) to prevent, at least to some extent, electrostatic sparks.

In some embodiments, the electric and/or heat properties of the compartment are suitable for storing electronic components that are sensitive to heat and/or electric fields and/or accumulated electric charge and/or high voltage and/or spurious sparks.

In some embodiments, the strap is formed with parts of a compartment and the parts are joined together as the strap is curled around forming at least one compartment. In some embodiments, a compartment is formed with additional elements. For example, pockets with closing flaps with a fastener such as hooks-and-loops.

In some embodiments of the invention, the compartment or part thereof are formed on the strap such that when the strap is curled around and edges thereof are connected, a bag is formed with the compartment inside the bag; namely, in the space between the walls formed by connecting or linking adjacent edges of the strap as the strap is curled around.

Optionally or alternatively, the compartment or part thereof are formed on the strap such that the compartment is formed outside the bag; namely, opposite the space formed by the walls by connecting or linking adjacent edges of the strap as the strap is curled around.

Optionally or alternatively, the compartment or part thereof are formed on the strap such that the compartment is formed on the rim of the bag; namely, about the border of the wall formed after connecting or linking adjacent edges of the strap as the strap have been curled around. Likewise, optionally a compartment is formed at the external bottom side of the bag.

FIG. 7 is a flowchart outlining operation for forming a coiled bag with a compartment, according to exemplary embodiments of the invention.

At 702 is provided a strap having at least one compartment thereon and a fastener about a circumference of the strap. In some embodiments, the at least one compartment comprises a plurality of compartments.

In some embodiments, providing a strap having a fastener about a circumference thereof comprises:

(a) Providing a strap;

(b) Providing a fastener; and (c) Attaching the fastener about the circumference of the strap.

At step 704 the strap is coiled and adjoining edges of the strap as the strap is coiled are connected by the fastener.

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment are necessary in every embodiment of the invention. Further combinations of the above features are also considered to be within the scope of some embodiments of the invention.

It will be appreciated by persons skilled in the art that the present invention is not limited to what has been particularly shown and described hereinabove. Rather the scope of the present invention is defined only by the claims, which follow.

The invention claimed is:

1. A coilable compartmented bag having a cavity, comprising:

a strap having a length and a first fastener about a circumference thereof, the strap progressively coilable for progressively forming a bag by linking adjoining coiled edges of the strap by the first fastener; and an at least one compartment constructed along the length of the strap, the compartment having two longitudinal boundaries, generally opposing each other, that are progressively separable and connectable by a second fastener disposed about the longitudinal boundaries and configured to form a closed pocket when openably connected by the second fastener.

2. The coilable compartmented bag according to claim 1, wherein the at least one compartment is constructed along the major part of the length of the strap.

3. The coilable compartmented bag according to claim 1, wherein the first fastener is a zipper member.

4. The coilable compartmented bag according to claim 1, wherein the second fastener is a zipper member.

5. The coilable compartmented bag according to claim 1, wherein the at least one compartment is formable inside the bag.

6. The coilable compartmented bag according to claim 1, wherein the at least one compartment is formable outside the bag.

* * * * *